US005540864A

United States Patent [19]

Michael

[11] Patent Number: 5,540,864

[45] Date of Patent: Jul. 30, 1996

[54] LIQUID HARD SURFCE DETERGENT COMPOSITIONS CONTAINING ZWITTERIONIC DETERGENT SURFACTANT AND MONOETHANOLAMINE AND/OR BETA-AMINOALKANOL

[75] Inventor: Daniel W. Michael, Cincinnati, Ohio

[73] Assignee: The Procter & Gamble Company, Cincinnati, Ohio

[21] Appl. No.: 457,788

[22] Filed: Jun. 2, 1995

Related U.S. Application Data

[63] Continuation of Ser. No. 818,499, Jan. 8, 1992, abandoned, which is a continuation of Ser. No. 628,067, Dec. 21, 1990, abandoned.

[51] Int. Cl.[6] ..... C11D 1/90; C11D 1/92; C11D 3/43; C11D 3/30

[52] U.S. Cl. ..... 510/181; 510/182; 510/490; 510/494; 510/426; 510/432; 510/405; 510/499; 510/429; 510/506

[58] Field of Search ..... 252/546, 545, 252/548, 173, DIG. 10, 153, 158, DIG. 7; 225/156

[56] References Cited

U.S. PATENT DOCUMENTS

| | | | |
|---|---|---|---|
| 3,280,179 | 10/1966 | Ernst | 260/501 |
| 3,309,321 | 3/1967 | McMaster | 252/152 |
| 3,417,025 | 12/1968 | Cooper et al. | 252/152 |
| 3,539,521 | 11/1970 | Snoddy et al. | 252/137 |
| 3,649,569 | 3/1972 | McCarty | 252/543 |
| 3,696,043 | 10/1972 | Labarge et al. | 252/153 |
| 3,775,559 | 8/1973 | Hewitt | 424/70 |
| 3,840,480 | 10/1974 | Barrat et al. | 252/545 |
| 3,842,847 | 10/1974 | Hewitt et al. | 132/7 |
| 3,849,548 | 11/1974 | Grand | 424/70 |
| 3,925,262 | 12/1975 | Laughlin et al. | 252/526 |
| 3,928,065 | 12/1975 | Savino | 134/7 |
| 3,928,251 | 12/1975 | Bolich, Jr. et al. | 252/545 |
| 3,935,130 | 1/1976 | Hirano et al. | 252/542 |
| 3,950,417 | 4/1976 | Verdicchio et al. | 252/545 |
| 3,962,418 | 6/1976 | Birkofer | 424/70 |
| 4,081,395 | 3/1978 | Talley | 252/106 |
| 4,110,263 | 8/1978 | Lindemann et al. | 252/545 |
| 4,148,762 | 4/1979 | Koch et al. | 252/544 |
| 4,214,908 | 7/1980 | Deguchi et al. | 106/13 |
| 4,246,131 | 1/1981 | Lohr | 252/153 |
| 4,252,665 | 2/1981 | Casey et al. | 252/106 |
| 4,257,907 | 3/1981 | Lagguth et al. | 252/106 |
| 4,259,217 | 3/1981 | Murphy | 252/547 |
| 4,261,869 | 4/1981 | Bishop et al. | 252/542 |
| 4,265,782 | 5/1981 | Armstrong et al. | 252/174.19 |
| 4,299,739 | 11/1981 | Esposito et al. | 252/545 |
| 4,329,334 | 5/1982 | Su et al. | 424/70 |

(List continued on next page.)

FOREIGN PATENT DOCUMENTS

| | | | |
|---|---|---|---|
| 88168 | 9/1982 | Australia | C11D 10/04 |
| 706409 | 3/1965 | Canada | 260/309.6 |
| 706408 | 3/1965 | Canada | 260/309.6 |
| 0004755 | 10/1979 | European Pat. Off. | C11D 1/94 |
| 0024031A1 | 2/1981 | European Pat. Off. | C11D 1/90 |
| 0040882A2 | 12/1981 | European Pat. Off. | C11D 3/16 |
| 0067635A2 | 12/1982 | European Pat. Off. | A61K 7/08 |
| 0106266A2 | 4/1984 | European Pat. Off. | C11D 3/43 |
| 0117135A2 | 8/1984 | European Pat. Off. | C11D 3/37 |
| 0157443 | 10/1985 | European Pat. Off. | C11D 1/83 |
| 0181212 | 5/1986 | European Pat. Off. | C11D 1/94 |
| 0205626A1 | 12/1986 | European Pat. Off. | C07C 143/14 |
| 0338850 | 10/1989 | European Pat. Off. | A61K 7/075 |
| 0373851A2 | 6/1990 | European Pat. Off. | C11D 1/94 |
| 0408174A1 | 1/1991 | European Pat. Off. | A61K 7/16 |
| 274332A3 | 12/1989 | Germany | C07C 143/15 |
| 275046A1 | 1/1990 | Germany | C07C 207/08 |
| 48-60706Q | 8/1973 | Japan . | |
| 59-189197A | 10/1984 | Japan | C11D 1/94 |
| 60-141797A | 7/1985 | Japan | C11D 1/94 |
| 60-161498A | 8/1985 | Japan | C11D 1/94 |
| 60-195200A | 10/1985 | Japan | C11D 1/94 |
| 61-014296A | 1/1986 | Japan | C11D 3/14 |
| 61-014298A | 1/1986 | Japan | C11D 3/43 |
| 61-009500A | 1/1986 | Japan | C11D 1/88 |
| 62-252499A | 11/1987 | Japan | C11D 3/60 |
| 62-257992A | 11/1987 | Japan | C11D 3/60 |
| 63-012333A | 1/1988 | Japan | B01F 17/16 |
| 01092298A | 4/1989 | Japan | C11D 1/88 |
| 01135898A | 5/1989 | Japan | A61K 7/7 |
| 01153796A | 6/1989 | Japan | A61K 7/7 |
| 01221496A | 9/1989 | Japan | C11D 1/2 |
| 01221497A | 9/1989 | Japan | C11D 1/62 |
| 02269200A | 2/1990 | Japan | C11D 1/94 |
| 02155996A | 6/1990 | Japan | C11D 10/04 |
| 02145697A | 6/1990 | Japan | C11D 1/92 |
| 02296899A | 12/1990 | Japan | A61K 7/7 |
| 03115495A | 5/1991 | Japan | C11D 1/10 |
| 03111494A | 5/1991 | Japan | C11D 1/94 |
| 03163052A | 7/1991 | Japan | C07C 233/47 |
| 03153797A | 7/1991 | Japan | C11D 1/88 |
| 03215410A | 9/1991 | Japan | A61K 7/7 |
| 03258900A | 11/1991 | Japan | A61K 7/7 |
| 84944A | 10/1984 | Romania | A61K 7/06 |
| 1554563 | 4/1979 | United Kingdom | C11D 1/94 |
| 2193505 | 2/1988 | United Kingdom | C11D 3/33 |
| WP91/09104 | 6/1991 | WIPO | C11D 7/32 |
| WO91/13610 | 9/1991 | WIPO | A61K 7/50 |
| WO91/15192 | 10/1991 | WIPO | A61K 7/50 |

OTHER PUBLICATIONS

Soap Based Detergent Formulations: XII. Alternate Synthesis of Surface Active Sulfobetaines, Parris et al., J. Amer. Oil Chem. Soc., vol. 53, Feb. 1976, pp. 60–63.

Zwitterionic Surfactants: Structure and Performance, Fernly, Journal of The Oil Chemists' Society, vol. 55, Jan. 1978, pp. 98–103.

(List continued on next page.)

*Primary Examiner*—Erin M. Harriman
*Attorney, Agent, or Firm*—Robert B. Aylor

[57] ABSTRACT

Aqueous, liquid hard surface detergent compositions contain zwitterionic detergent surfactant and monoethanolamine and/or other specific beta-aminoalkanols as solvents and/or buffers for improved spotting/filming and good cleaning. Some formulas do not contain large amounts of builders and are suitable for general purpose cleaning including cleaning of glass.

19 Claims, No Drawings

U.S. PATENT DOCUMENTS

| | | | |
|---|---|---|---|
| 4,329,335 | 5/1982 | Su et al. | 424/70 |
| 4,372,869 | 2/1983 | Lindemann et al. | 252/174.16 |
| 4,375,421 | 3/1983 | Rubin et al. | 252/110 |
| 4,396,525 | 8/1983 | Rubin et al. | 252/174 |
| 4,414,128 | 11/1983 | Goffinet | 252/111 |
| 4,420,484 | 12/1983 | Gorman et al. | 424/326 |
| 4,421,680 | 12/1983 | Shivar | 252/526 |
| 4,438,096 | 3/1984 | Preston | 424/70 |
| 4,443,362 | 4/1984 | Guth et al. | 252/545 |
| 4,450,091 | 5/1984 | Schmolka | 252/174.21 |
| 4,452,732 | 6/1984 | Bolich, Jr. | 252/547 |
| 4,477,365 | 10/1984 | Verboom et al. | 252/156 |
| 4,485,029 | 11/1984 | Kato et al. | 252/106 |
| 4,490,355 | 12/1984 | Desai | 424/70 |
| 4,529,588 | 7/1985 | Smith et al. | 424/70 |
| 4,534,964 | 11/1985 | Herstein et al. | 424/70 |
| 4,554,098 | 11/1985 | Klisch et al. | 252/547 |
| 4,557,898 | 12/1985 | Greene et al. | 422/28 |
| 4,654,207 | 3/1987 | Preston | 424/70 |
| 4,666,621 | 5/1987 | Clark et al. | 252/91 |
| 4,673,523 | 6/1987 | Smith et al. | 252/91 |
| 4,683,008 | 7/1987 | Betts | 134/27 |
| 4,692,277 | 9/1987 | Siklosi | 252/558 |
| 4,698,181 | 10/1987 | Lewis | 252/527 |
| 4,749,509 | 6/1988 | Kacher | 252/139 |
| 4,769,169 | 9/1988 | Fishlock-Lomax | 252/106 |
| 4,769,172 | 9/1988 | Siklosi | 252/153 |
| 4,772,424 | 9/1988 | Greeb | 252/546 |
| 4,784,786 | 11/1988 | Smith et al. | 252/91 |
| 4,810,421 | 3/1989 | Marchesini | 252/546 |
| 4,828,849 | 5/1989 | Lynch et al. | 424/54 |
| 4,861,517 | 8/1989 | Bade | 252/546 |
| 4,913,841 | 4/1990 | Zeman | 252/352 |
| 4,921,629 | 5/1990 | Malihi et al. | 252/170 |
| 4,948,531 | 8/1990 | Fuggini et al. | 252/544 |
| 5,015,412 | 5/1991 | Zeman | 252/311 |
| 5,061,393 | 10/1991 | Linares et al. | 252/143 |
| 5,108,660 | 4/1992 | Michael . | |

OTHER PUBLICATIONS

Chem. Abstract 102(22):190818t—P. Busch et al., "Hair–conditioning effect of guar hydroxypropyl–trimethylammonium chloride. Part I.", Parfuem. Kosmet. 1984 65(11), 692, 694–6, 698. (no month available).

Chem. Abstract 102(22):190819u—P. Busch et al., "Hair–conditioning effect of guar hydroxypropyl–trimethylammonium chloride. Part 2.", Parfuem. Kosmet. 1984 65(12), 756, 758–60. (no month available).

Chem. Abstract 108(1):5366g—C. A. Bunton, "Micellar effects on nucleophil–icity," Adv. Chem. Ser. 1987, 215(Nucleophilicity), 425–41. (no month available).

Chem. Abstract 115(6):56929v—CTFA, Inc.., "Final report on the safety assessment of cocamidopropyl betaine," J. Am. Coll. Toxicol. 1991, 10(1). 33–52. (no month available).

Chem. Abstract 115(14):138653q—V. Allikmaa, "Highly efficient reversed–phase HPLC studies of amphoteric and cationic amido group–containing surfactants," Eesti Tead. Akad. Toim., Keem 1991, 40(1), 67–72. (no month available).

N. Parris et al., "Soap Based Detergent Formulations. V. Amphoteric Lime Soap Dispersing Agents," JAOCS, 50(1973) pp. 509–512. (no month available).

W. R. Noble et al., "Soap–Based Detergent Formulations: X. Nature of Detergent Deposits," JAOCS, 52(1975) pp. 1–4. (no month available).

N. Parris et al., "Soap–Based Detergent Formulations: XII. Alternate Syntheses of Surface Active Sulfobetaines," JAOCS, 53(1976) pp. 60–63. (no month available).

F. D. Smith et al., "Soap–Based Detergent Formulations: XV. Amino Esters of alpha–Sulfo Fatty Acids," JAOCS, 53(1976) pp. 69–72. (no month available).

Parris et al., "Soap–Based Detergent Formulations: XVIII. Effect of Structure Variations on Surface–Active Properties of Sulfur Containing Amphoteric Surfactants," JAOCS, 53(1976) pp. 97–100. (no month available).

J. K. Weil et al., "Soap–Based Detergent Formulations: XX. The Physical and Chemical Nature of Lime Soap Dispersions," JAOCS, 53(1976) pp. 757–761. (no month available).

J. K. Weil et al., "The Mutual Solubilization of Soap and Lime Soap Dispersing Agents," JAOCS, 54(1977) pp. 1–3. (no month available).

T. J. Micich et al., "Soap–Based Detergent Formulations: XIX. Amphoteric Alkylsuccinamide Derivatives as Lime Soap Dispersants," JAOCS, 54(1977) pp. 91–94. (no month available).

T. J. Micich et al., "Soap–Based Detergent Formulations: XXII. Sulfobetaine Derivatives of N–Alkylglutaramides and Adipamides," JAOCS, 54(1977) pp. 264–266. (no month available).

N. Parris et al., "Soap Based Detergent Formulation: XXIV. Sulfobetaine Derivatives of Fatty Amides," JAOCS, 54(1977), pp. 294–296. (no month available).

J. K. Weil et al., "Surface Active Properties of Combinations of Soap and Lime Soap Dispersing Agents," JAOCS, 54(1976) pp. 339–342. (no month available).

J. M. Kaminski et al., "Soap–Based Detergent Formulations: XXIII. Synthesis of p–Sulfobenzyl Ammonium Inner Salts and Structural Correlation with Analogous Amphoterics," JAOCS, 54(1977) pp. 516–520 (no month available).

F. D. Smith et al., "Soap–based Detergent Formulations: XXI. Amphoteric Derivatives of Fatty Amides of Aminoethylethanolamine," JAOCS, 55(1978) pp. 741–744. (no month available).

J. M. Kaminski et al., "Soap–Based Detergent Formulations: XXV. Synthesis and Surface Active Properties of Higher Molecular Weight Betaine Lime Soap Dispersants," JAOCS, 56(1979) pp. 771–774. (no month available).

W. M. Linfield, "Soap and Lime Soap Dispersants," JAOCS, 55(1978), pp. 87–92. (no month available).

W. R. Noble et al., "Soap–based Detergent Formulations: XXVI. Hard Water Detergency of Soap–lime Soap Dispersant Combinations with Builders and Inorganic Salts," JAOCS, 57(1980), pp. 368–372. (no month available).

J. G. Weers et al., "Effect of the intramolecular charge separation distance on the solution properties of betaines and sulfobetaines," Lagmuir, 1991, vol. 7(5), pp. 854–867. (Absract only) (no month available).

T. Takeda et al., "Synthesis and properties of a,w–bis(amidopropylhydroxy–sulfobetaine)–type amphoteric surfactants," Yukagaku, 1990, vol. 39(8), pp. 576–579. (Abstract only) (no month available).

LIQUID HARD SURFCE DETERGENT COMPOSITIONS CONTAINING ZWITTERIONIC DETERGENT SURFACTANT AND MONOETHANOLAMINE AND/OR BETA-AMINOALKANOL

This is a continuation of application Ser. No. 07/818,499, filed on Jan. 8, 1992, now abandoned which is a continuation application Ser. No. 07/628,067, filed Dec. 21, 1990, now abandoned.

FIELD OF THE INVENTION

This invention pertains to liquid detergent compositions for use in cleaning hard surfaces. Such compositions typically contain detergent surfactants, solvents, builders, etc.

BACKGROUND OF THE INVENTION

The use of solvents and organic water-soluble synthetic detergents at low levels for cleaning glass are known.

General purpose household cleaning compositions for hard surfaces such as metal, glass, ceramic, plastic and linoleum surfaces, are commercially available in both powdered and liquid form. Liquid detergent compositions are disclosed in Australian Pat. Application 82/88168, filed Sep. 9, 1982, by The Procter & Gamble Company; U.K. Pat. Application GB 2,166,153A, filed Oct. 24, 1985, by The Procter & Gamble Company; and U.K. Pat. Application GB 2,160,887A, filed Jun. 19, 1985, by Bristol-Myers Company, all of said published applications being incorporated herein by reference. These liquid detergent compositions comprise certain organic solvents, surfactant, and optional builder and/or abrasive. The prior art, however, fails to teach, or recognize, the advantage of the specific organic solvents/buffers disclosed hereinafter, in liquid hard surface cleaner formulations.

Liquid cleaning compositions have the great advantage that they can be applied to hard surfaces in neat or concentrated form so that a relatively high level of surfactant material and organic solvent is delivered directly to the soil. Moreover, it is a rather more straightforward task to incorporate high concentrations of anionic or nonionic surfactant in a liquid rather than a granular composition. For both these reasons, therefore, liquid cleaning compositions have the potential to provide superior soap scum, grease, and oily soil removal over powdered cleaning compositions.

Nevertheless, liquid cleaning compositions, and especially compositions prepared for cleaning glass, still suffer a number of drawbacks which can limit their consumer acceptability. They have to have good spotting/filming properties. In addition, they can suffer problems of product form, in particular, inhomogeneity, lack of clarity, or inadequate viscosity characteristics, or excessive "solvent" odor for consumer use.

An object of the present invention is to provide detergent compositions which provide good glass cleaning without excessive filming and/or streaking.

SUMMARY OF THE INVENTION

The present invention relates to an aqueous, liquid, hard surface detergent composition comprising: (a) zwitterionic detergent surfactant, containing a cationic group, preferably a quaternary ammonium group, and an anionic group, preferably a carboxylate, sulfonate, or sulfate group, more preferably a sulfonate group; (b) solvent/buffer system that comprises either monoethanolamine, beta-aminoalkanol which contains from about three to about six carbon atoms, or mixtures thereof, preferably monoethanolamine; (c) optional detergent builder; and the balance being (d) aqueous solvent system and, optionally, minor ingredients. The composition preferably does not contain amounts of materials, like conventional detergent builders, etc., that deposit on the surface being cleaned and cause unacceptable spotting/filming. The compositions can be formulated at usage concentrations, or as concentrates, and can be packaged in a container having means for creating a spray to make application to hard surfaces more convenient.

All percentages, parts, and ratios herein are "by weight" unless otherwise stated.

DETAILED DESCRIPTION OF THE INVENTION

In accordance with the present invention, it has been found that superior aqueous liquid detergent compositions for cleaning shiny surfaces such as glass contain zwitterionic detergent surfactant (containing both cationic and anionic groups in substantially equivalent proportions so as to be electrically neutral at the pH of use, typically at least about 9.5, preferably at least about 10) and monoethanolamine and/or certain beta-amino-alkanol compounds.

The Detergent Surfactant

The aqueous, liquid hard surface detergent compositions (cleaners) herein contain from about 0.001% to about 15% of suitable zwitterionic detergent surfactant containing a cationic group, preferably a quaternary ammonium group, and an anionic group, preferably carboxylate, sulfate and/or sulfonate group, more preferably sulfonate. Successively more preferred ranges of zwitterionic detergent surfactant inclusion are from about 0.02% to about 10% of surfactant, and from about 0.1% to about 5% of surfactant.

Zwitterionic detergent surfactants, as mentioned hereinbefore, contain both a cationic group and an anionic group and are in substantial electrical neutrality where the number of anionic charges and cationic charges on the detergent surfactant molecule are substantially the same. Zwitterionic detergents, which typically contain both a quaternary ammonium group and an anionic group selected from sulfonate and carboxylate groups are desirable since they maintain their amphoteric character over most of the pH range of interest for cleaning hard surfaces. The sulfonate group is the preferred anionic group.

Preferred zwitterionic detergent surfactants have the generic formula:

$$R^3\text{-}[C(O)\text{-}N(R^4)\text{-}(CR^5{}_2)_n]_mN(R^6)_2(+)\text{-}(CR^5{}_2)_p\text{-}Y(-)$$

wherein each y is preferably a carboxylate ($COO^-$) or sulfonate ($SO_3^-$) group, preferably sulfonate; wherein each $R^3$ is a hydrocarbon, e.g., an alkyl, or alkylene, group containing from about 8 to about 20, preferably from about 10 to about 18, more preferably from about 12 to about 16 carbon atoms; wherein each ($R^4$) is either hydrogen, or a short chain alkyl, or substituted alkyl, containing from one to about four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups; wherein ($R^6$) is like $R^4$ except preferably not hydrogen; wherein m is 0 or 1; and wherein each n and p are a number from 1 to about 4, preferably from 2 to about 3, more preferably about 3; there being no more than about one hydroxy group in any $(CR^5{}_2)$ moiety. The $R^3$ groups can be branched and/or unsaturated, and such structures can provide spotting/filming benefits, even when used as part of a mixture with straight chain alkyl $R^3$ groups. The $R^4$ groups can also be connected to form ring structures. Preferred hydrocarbyl amidoalkylene sulfobetaine (HASB) detergent surfactants wherein m=1 and y is a sulfonate group provide superior grease soil removal and/or filming/streaking and/or "anti-fogging" and/or perfume solubilization properties. Such hydrocarbylamidoalkylene betaines and, especially, hydrocarbylamidoalkylene sulfobetaines are excellent for use in hard surface cleaning detergent compositions, especially those formulated for use on both glass and hard-to-remove soils. They are even better when used with monoethanolamine and/or specific beta-amino alkanol as disclosed herein.

A more preferred specific detergent surfactant is a $C_{10-14}$ fatty acylamidopropylene(hydroxypropylene)sulfobetaine, e.g., the detergent surfactant available from the Sherex Company as a 40% active product under the trade name "Varion CAS Sulfobetaine."

The level of zwitterionic detergent surfactant, e.g., HASB, in the composition is typically from about 0.001% to about 15%, preferably from about 0.05% to about 10%, more preferably from about 0.2% to about 5%. The level in the composition is dependent on the eventual level of dilution to make the wash solution. For glass cleaning, the composition, when used full strength, or wash solution containing the composition, should contain from about 0.02% to about 1%, preferably from about 0.05% to about 0.5%, more preferably from about 0.1% to about 0.25%, of detergent surfactant. For removal of difficult to remove soils like grease, the level can, and should be, higher, typically from about 0.1% to about 10%, preferably from about 0.25% to about 2%. Concentrated products will typically contain from about 0.2% to about 10%, preferably from about 0.3% to about 5%. It is an advantage of the zwitterionic detergent, e.g., HASB, that compositions containing it can be more readily diluted by consumers since it does not interact with hardness cations as readily as conventional anionic detergent surfactants. Zwitterionic detergents are also extremely effective at very low levels, e.g., below about 1%.

Other zwitterionic detergent surfactants are set forth at Col. 4 of U.S. Pat. No. 4,287,080, Siklosi, incorporated herein by reference. Another detailed listing of suitable zwitterionic detergent surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

The above patents and reference also disclose other detergent surfactants, e.g., anionic, and nonionic detergent surfactants, that can be used in small amounts in the composition of this invention as cosurfactants. Typical of these are the alkyl- and alkylethoxylate- (polyethoxylate) sulfates, paraffin sulfonates, olefin sulfonates, alkoxylated (especially ethoxylated) alcohols and alkyl phenols, alpha-sulfonates of fatty acids and of fatty acid esters, and the like, which are well-known from the detergency art. When the pH is above about 9.5, detergent surfactants that are amphoteric at a lower pH are desirable anionic detergent cosurfactants. For example, detergent surfactants which are $C_{12}$–$C_{18}$ acylamido alkylene amino alkylene sulfonates, e.g., compounds having the formula $R—C(O)—NH—(C_2H_4)—N(C_2H_4OH)—CH_2CH(OH)CH_2SO_3M$ wherein R is an alkyl group containing from about 9 to about 18 carbon atoms and M is a compatible cation are desirable cosurfactants. These detergent surfactants are available as Miranol CS, OS, JS, etc. The CTFA adopted name for such surfactants is cocoamphohydroxypropyl sulfonate. It is preferred that the compositions be substantially free of alkyl naphthalene sulfonates.

In general, detergent surfactants useful herein contain a hydrophobic group, typically containing an alkyl group in the $C_9$–$C_{18}$ range, and, optionally, one or more linking groups such as ether or amido, preferably amido groups. The anionic detergent surfactants can be used in the form of their sodium, potassium or alkanolammonium, e.g., triethanolammonium salts; the nonionics generally contain from about 5 to about 17 ethylene oxide groups. $C_{12}$–$C_{18}$ paraffinsulfonates and alkyl sulfates, and the ethoxylated alcohols and alkyl phenols are especially preferred in the compositions of the present type.

Some suitable surfactants for use in such cleaners are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol 15-S-3, Tergitol 15-S-5, Tergitol 15-S-7, and Tergitol 15-S-9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide having one of the preferred formulas:

$$R^1—\overset{\overset{\displaystyle O}{\|}}{C}—N(R^2)_2$$

wherein $R^1$ is a straight-chain alkyl group containing from about 7 to about 15 carbon atoms and having an average carbon chain length of from about 9 to about 13 carbon atoms and wherein each $R^2$ is a hydroxy alkyl group containing from 1 to about 3 carbon atoms; a zwitterionic surfactant having one of the preferred formulas set forth hereinafter; or a phosphine oxide surfactant. Another suitable class of surfactants it the fluorocarbon surfactants, examples of which are FC-129, a potassium fluorinated alkylcarboxylate and FC-170-C, a mixture of fluorinated alkyl polyoxyethylene ethanols, both available from 3M Corporation, as well as the Zonyl fluorosurfactants, available from DuPont Corporation. It is understood that mixtures of various surfactants can be used.

MONOETHANOLAMINE AND/OR BETA-AMINOALKANOL

Monoethanolamine and/or beta-aminoalkanol compounds serve primarily as solvents when the pH is above about 10.0, and especially above about 10.7. They also provide alkaline buffering capacity during use. However, the most unique contribution they make is to improve the spotting/filming properties of hard surface cleaning compositions containing zwitterionic detergent surfactant, whereas they do not provide any substantial improvement in spotting/filming when used with conventional anionic or ethoxylated nonionic detergent surfactants. The reason for the improvement is not known. It is not simply a pH effect, since the improvement is not seen with conventional alkalinity sources. Other similar materials that are solvents do not provide the same benefit and the effect can be different depending upon the other materials present. When perfumes that have a high percentage of terpenes are incorporated, the benefit is greater for the betaalkanolamines, and they are often preferred, whereas the monoethanolamine is usually preferred.

Monoethanolamine and/or beta-alkanolamine are used at a level of from about 0.05% to about 10%, preferably from about 0.2% to about 5%. For dilute compositions they are typically present at a level of from about 0.05% to about 2%, preferably from about 0.1% to about 1.0%, more preferably from about 0.2% to about 0.7%. For concentrated compositions they are typically present at a level of from about 0.5% to about 10%, preferably from about 1% to about 5%.

Preferred beta-aminoalkanols have a primary hydroxy group. Suitable beta-aminoalkanols have the formula:

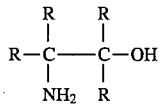

wherein each R is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino,1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The betaaminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

The beta-aminoalkanols are surprisingly better than, e.g., monoethanolamine for hard surface detergent compositions that contain perfume ingredients like terpenes and similar materials. However, normally the monoethanolamine is preferred for its effect in improving the spotting/filming performance of compositions containing zwitterionic detergent surfactant. The improvement in spotting/filming of hard surfaces that is achieved by combining the monoethanolamine and/or beta-aminoalkanol was totally unexpected.

Good spotting/filming, i.e., minimal, or no, spotting/filming, is especially important for cleaning of, e.g, window glass or mirrors where vision is affected and for dishes and ceramic surfaces where spots are aesthetically undesirable. Beta-aminoalkanols provide superior cleaning of hard-to-remove greasy soils and superior product stability, especially under high temperature conditions, when used in hard surface cleaning compositions, especially those containing the zwitterionic detergent surfactants.

Beta-aminoalkanols, and especially the preferred 2-amino-2-methylpropanol, are surprisingly volatile from cleaned surfaces considering their relatively high molecular weights.

The Cosolvent

In order to obtain good cleaning without any appreciable amount of detergent builder, one can use a cosolvent that has cleaning activity in addition to the monoethanolamine and/or betaaminoalkanol. The cosolvents employed in the solvent/buffer system in the hard surface cleaning compositions herein can be any of the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula $$\gamma H = \gamma T \left[ \frac{\alpha - 1}{\alpha} \right]^{1/2}$$

wherein $\gamma H$ is the hydrogen bonding parameter, $\alpha$ is the aggregation number, $$\left( \text{Log}\ \alpha = 3.39066\ T_b/T_c - 0.15848 - \text{Log}\ \frac{M}{d} \right), \text{ and}$$

$\gamma T$ is the solubility parameter which is obtained from the formula $$\gamma T = \left[ \frac{(\Delta H_{25} - RT)d}{M} \right]^{1/2}$$

where $\Delta H_{25}$ is the heat of vaporization at 25° C., R is the gas constant (1.987 cal/mole/deg), T is the absolute temperature in °K, $T_b$ is the boiling point in °K, $T_c$ is the critical temperature in °K, d is the density in g/ml, and M is the molecular weight.

For the compositions herein, hydrogen bonding parameters are preferably less than about 7.7, more preferably from about 2 to about 7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

Cosolvents are typically used at a level of from about 1% to about 30%, preferably from about 2% to about 15%, more preferably from about 4% to about 8%. Dilute compositions typically have cosolvents at a level of from about 1% to about 10%, preferably from about 3% to about 6%. Concentrated compositions contain from about 10% to about 30%, preferably from about 10% to about 20% of cosolvent.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of cosolvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^6O-(R^7O-)_mH$ wherein each $R^6$ is an alkyl group which contains from about 3 to about 8 carbon atoms, each $R^7$ is either ethylene or propylene, and m is a number from 1 to about 3. The most preferred glycol ethers are selected from the group consisting of monopropyleneglycolmonopropyl ether, dipropyleneglycolmonobutyl ether, monopropyleneglycolmonobutyl ether, diethyleneglycolmonohexyl ether, monoethyleneglycolmonohexyl ether, monoethyleneglycolmonobutyl ether, and mixtures thereof.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Some examples of suitable diol solvents and their solubilities in water are shown in Table 1.

TABLE 1

Solubility of Selected Diols in 20° C. Water

| Diol | Solubility (g/100 g $H_2O$) |
|---|---|
| 1,4-Cyclohexanedimethanol | 20.0* |
| 2,5-Dimethyl-2,5-hexanediol | 14.3 |
| 2-Phenyl-1,2-propanediol | 12.0* |
| Phenyl-1,2-ethanediol | 12.0* |
| 2-Ethyl-1,3-hexanediol | 4.2 |
| 2,2,4-Trimethyl-1,3-pentanediol | 1.9 |
| 1,2-Octanediol | 1.0* |

*Determined via laboratory measurements. All other values are from published literature.

The diol solvents are especially preferred because, in addition to good grease cutting ability, they impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

Solvents such as pine oil, orange terpene, benzyl alcohol, n-hexanol, phthalic acid esters of $C_{1-4}$ alcohols, butoxy propanol, Butyl Carbitol® and 1(2-n-butoxy-1-methylethoxy)propane-2-ol (also called butoxy propoxy propanol or dipropylene glycol monobutyl ether), hexyl diglycol (Hexyl Carbitol®), butyl triglycol, diols such as 2,2,4-trimethyl-1,3-pentanediol, and mixtures thereof, can be used. The butoxy-propanol solvent should have no more than about 20%, preferably no more than about 10%, more preferably no more than about 7%, of the secondary isomer in which the butoxy group is attached to the secondary atom of the propanol for improved odor.

The Cobuffer/Alkalinity-Source

The solvent/buffer system is formulated to give a pH in the product and, at least initially, in use of from about 9.5 to about 13, preferably from about 9.7 to about 12, more preferably from about 9.7 to about 11.5. pH is usually measured on the product. The buffering system comprises monoethanolamine and/or betaaminoalkanol and, optionally, but preferably, cobuffer and/or alkaline material selected from the group consisting of: ammonia; other $C_2$–$C_4$ alkanolamines; alkali metal hydroxides; silicates; borates; carbonates; and/or bicarbonates; and mixtures thereof. The preferred cobuffering/alkalinity materials are alkali metal hydroxides. The level of the cobuffer/alkalinity-source is from 0% to about 5%, preferably from 0% to about 5%. Monoethanolamine and/or beta-aminoalkanol buffering material, in the system is important for spotting/filming. It is surprising that monoethanolamine and/or beta-aminoalkanol provides improved spotting/filming when used with the zwitterionic detergent surfactant.

The Aqueous Solvent System

The balance of the formula is typically water and non-aqueous polar solvents with only minimal cleaning action like methanol, ethanol, isopropanol, ethylene glycol, propylene glycol, and mixtures thereof. The level of non-aqueous polar solvent is greater when more concentrated formulas are prepared. Typically, the level of non-aqueous polar solvent is from about 0.5% to about 40%, preferably from about 1% to about 10% and the level of water is from about 50% to about 99%, preferably from about 75% to about 95%.

Optional Ingredients

The compositions herein can also contain other various adjuncts which are known to the art for detergent compositions. Preferably they are not used at levels that cause unacceptable spotting/filming. Nonlimiting examples of such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Antibacterial agents can be present, but preferably only at low levels to avoid spotting/filming problems. More hydrophobic antibacterial/germicidal agents, like orthobenzyl-para-chlorophenol, are avoided. If present, such materials should be kept at level s below about 0.1%.

Detergent Builder

An optional ingredient for general cleaning purposes, is from 0% to about 30%, preferably from about 1% to about 15%, more preferably from about 1% to about 12%, of detergent builder. For use on glass and/or other shiny surfaces, a level of builder of from about 0.1% to about 0.5%, preferably from about 0.1% to about 0.2%, is useful. While any of the builders or inorganic salts can be used herein, some examples of builders for use herein are sodium nitrilotriacetate, potassium pyrophosphate, potassium tripolyphosphate, sodium or potassium ethane-1-hydroxyl-1,1-diphosphonate, the nonphosphorous chelating agents described in the copending U.S. patent application Ser. No. of Culshaw and Vos, Ser. No. 285,337, filed Dec. 14, 1988, said application being incorporated herein by reference (e.g., carboxymethyltartronic acid, oxydimalonic acid, tartrate monosuccinic acid, oxydisuccinic acid, tartrate disuccinic acid, and mixtures thereof), sodium citrate, sodium carbonate, sodium sulfite, sodium bicarbonate, and so forth.

Other suitable builders are disclosed in U.S. Pat. No. 4,769,172, Siklosi, issued Sep. 6, 1988, and incorporated herein by reference, and chelating agents having the formula:

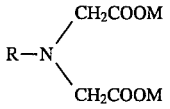

wherein R is selected from the group consisting of: $—CH_2CH_2CH_2OH$; $—CH_2CH(OH)CH_3$; $—CH_2CH(OH)CH_2OH$; $—CH_2CH_2OH)_3$; $CH_3$; $—CH_2CH_2OCH_3$;

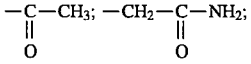

$—CH_2CH_2CH_2OCH_3$; $—C(CH_2OH)_3$; and mixtures thereof; and each M is hydrogen or an alkali metal ion.

Chemical names of the acid form of some chelating agents useful herein include:

N(3-hydroxypropyl)imino-N,N-diacetic acid (3-HPIDA);

N(-2-hydroxypropyl )imino-N,N-diacetic acid (2-HPIDA);

N-glycerylimino-N,N-diacetic acid (GLIDA);

dihydroxyisopropylimino-(N,N)-diacetic acid (DHPIDA);

methylimino-(N,N)-diacetic acid (MIDA);

2-methoxyethylimino-(N,N)-diacetic acid (MEIDA);

amidoiminodiacetic acid (also known as sodium amidonitrilotriacetic, SAND);

acetamidoiminodiacetic acid (AIDA);

3-methoxypropylimino-N,N-diacetic acid (MEPIDA); and tris(hydroxymethyl)methylimino-N,N-diacetic acid (TRIDA).

Methods of preparation of the iminodiacetic derivatives herein are disclosed in the following publications:

Japanese Laid Open publication 59-70652, for 3-HPIDA;

DE-OS-25 42 708, for 2-HPIDA and DHPIDA;

Chem. ZVESTI 34(1) p. 93-103 (1980), Mayer, Riecanska et al., publication of Mar. 26, 1979, for GLIDA;

C. A. 104(6)45062 d for MIDA; and

Biochemistry 5, p. 467 (1966) for AIDA.

The levels of builder present in the wash solution used for glass should be less than about 0.5%, preferably less than about 0.2%. Therefore, dilution is highly preferred for cleaning glass, while full strength use is preferred for general purpose cleaning.

Other effective detergent builders, e.g., sodium citrate, sodium ethylenediaminetetraacetate, etc., can also be used, preferably at lower levels, e.g., from about 0.1% to about 1%, preferably from about 0.1% to about 0.5%.

Inclusion of a detergent builder improves cleaning, but harms spotting and filming and has to be considered as a compromise in favor of cleaning. Inclusion of a detergent builder is optional and low levels are usually more preferred than high levels.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. It is a special advantage of this invention that perfume ingredients are readily solubilized in the compositions by the acylamidoalkylene detergent surfactant. Other similar detergent surfactants will not solubilize as much perfume, especially substantive perfume, or maintain uniformity to the same low temperature.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Normally, the art recognized perfume compositions are not very substantive as described hereinafter to minimize their effect on hard surfaces.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 or above, and are detectable at levels below those of the average perfume material.

Perfumes can also be classified according to their volatility, as mentioned hereinbefore. The highly volatile, low boiling, perfume ingredients typically have boiling points of about 250° C. or lower. Many of the more moderately volatile perfume ingredients are also lost substantially in the cleaning process. The moderately volatile perfume ingredients are those having boiling points of from about 250° C. to about 300° C. The less volatile, high boiling, perfume ingredients referred to hereinbefore are those having boiling points of about 300° C. or higher. A significant portion of even these high boiling perfume ingredients, considered to be substantive, is lost during the cleaning cycle, and it is desirable to have means to retain more of these ingredients on the dry surfaces. Many of the perfume ingredients, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso -menthone, myrcene, myrcenyl acetate, myrcenol, nerol, neryl acetate, nonyl acetate, phenyl ethyl alcohol, alphapinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanilin, eugenol, iso-eugenol, flor acetate, heliotropine, 3-cis-hexenyl salicylate, hexyl salicylate, lilial (para-tertiarybutyl-alpha-methyl hydrocinnamic aldehyde), gammamethyl ionone, nerolidol, patchouli alcohol, phenyl hexanol, betasel inene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclo-penta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations, but more water-soluble materials are preferred, as stated hereinbefore, since such materials are less likely to adversely affect the good spotting/filming properties of the compositions. If the terpene types of perfume ingredients are used, the beta-aminoalkanols are preferred for product stability.

These compositions have exceptionally good cleaning properties. They can also be formulated to have good "shine" properties, i.e., when used to clean glossy surfaces, without rinsing.

The compositions can be formulated to be used at full strength, where the product is sprayed onto the surface to be cleaned and then wiped off with a suitable material like cloth, a paper towel, etc. They can be packaged in a package that comprises a means for creating a spray, e.g., a pump, aerosol propel pellant and spray valve, etc.

The invention is illustrated by the following Examples.

EXAMPLE I

| Ingredient | Formula No.* (Wt. %) 1 | 2 | 3 | 4 |
|---|---|---|---|---|
| Propylene Glycol Mono-butylether | 2.0 | 2.0 | 2.0 | 2.0 |
| Isopropanol | 5.0 | 5.0 | 5.0 | 5.0 |
| Cocoamidopropyl (Hydroxy-propyl)sulfobetaine | 0.15 | 0.15 | 0.15 | 0.15 |
| Monoethanolamine | 1.0 | — | — | — |
| 1-amino-2-propanol | — | 1.0 | — | — |
| 2-amino-1-butanol | — | — | 1.0 | — |
| 2-amino-2-methyl-1-butanol | — | — | — | 1.0 |

-continued

| Ingredient | Formula No.* (Wt. %) 1 | 2 | 3 | 4 |
|---|---|---|---|---|
| Perfume | 0.20 | 0.20 | 0.20 | 0.20 |
| Deionized Water | q.s. | q.s. | q.s. | q.s. |

*pH adjusted to about 11.3

| Ingredient | Formula No.* (Wt. %) 1 | 2 | 3 |
|---|---|---|---|
| Lauryl-dimethyl-3-sulfopropylbetaine | 0.20 | — | — |
| Cocoyl-dimethyl-2-hydroxy-3-sulfopropylbetaine | — | 0.20 | — |
| Lauryl-dimethyl-betaine | — | — | 0.20 |
| Cocoamidipropyl-dimethyl-betaine | — | — | — |
| Cocoamidopropyl-dimethyl-2-hydroxy-3-sulfopropylbetaine | — | — | — |
| Sodium Alkyl (~$C_{13}$) Sulfate | | | |
| 2-Amino-2-methyl-1-propanol | | | |
| Monoethanolamine | 0.5 | 0.5 | 0.5 |
| Propylene Glycol Mono-butylether | 3.0 | 3.0 | 3.0 |
| Isopropanol | 3.0 | 3.0 | 3.0 |
| Deionized Water and Minors (e.g., Perfume) | q.s. | q.s. | q.s. |

| Ingredient | Formula No.* (Wt. %) 4 | 5 | 6 |
|---|---|---|---|
| Lauryl-dimethyl-3-sulfopropylbetaine | — | — | — |
| Cocoyl-dimethyl-2-hydroxy-3-sulfopropylbetaine | — | — | — |
| Lauryl-dimethyl-betaine | — | — | — |
| Cocoamidipropyl-dimethyl-betaine | 0.20 | — | — |
| Cocoamidopropyl-dimethyl-2-hydroxy-3-sulfopropylbetaine | — | 0.20 | 0.18 |
| Sodium Alkyl (~$C_{13}$) Sulfate | — | — | 0.02 |
| 2-Amino-2-methyl-1-propanol | — | — | — |
| Monoethanolamine | 0.5 | 0.5 | 0.5 |
| Propylene Glycol Mono-butylether | 3.0 | 3.0 | 3.0 |
| Isopropanol | 3.0 | 3.0 | 3.0 |
| Deionized Water and Minors (e.g., Perfume) | q.s. | q.s. | q.s. |

| Ingredient | Formula No.* (Wt. %) 7 | 8 | 9 |
|---|---|---|---|
| Lauryl-dimethyl-3- | — | — | — |
| Lauryl-dimethyl-3-sulfopropylbetaine | | | |
| Cocoyl-dimethyl-2-hydroxy-3-sulfopropylbetaine | — | — | — |
| Lauryl-dimethyl-betaine | — | — | — |
| Cocoamidipropyl-dimethyl-betaine | 0.15 | 0.18 | 0.15 |
| Cocoamidopropyl-dimethyl-2-hydroxy-3-sulfopropylbetaine | — | — | — |
| Sodium Alkyl (~$C_{13}$) Sulfate | — | — | — |
| 2-amino-2-methyl-1-propanol | 0.5 | — | — |
| Monoethanolamine | — | 0.5 | 0.5 |
| Propylene Glycol Mono-butylether | 3.0 | 4.0 | — |
| Ethylene Glycol Monobutylether | — | — | 3.0 |
| Isopropanol | 3.0 | 2.0 | 3.0 |
| Deionized Water and Minors (e.g., Perfume) | q.s. | q.s. | q.s. |

-continued

| Ingredient | Formula No.* (Wt. %) 10 | 11 | 12 |
|---|---|---|---|
| Lauryl-dimethyl-3-sulfopropylbetaine | — | — | — |
| Cocoyl-dimethyl-2-hydroxy-3-sulfopropylbetaine | — | — | — |
| Lauryl-dimethyl-betaine | — | — | — |
| Cocoamidipropyl-dimethyl-betaine | — | — | — |
| Cocoamidopropyl-dimethyl-2-hydroxy-3-sulfopropylbetaine | 0.19 | 0.15 | 0.18 |
| Sodium Alkyl (~$C_{13}$) Sulfate | — | — | — |
| 2-amino-2-methyl-1-propanol | 0.5 | — | 1.0 |
| Monoethanolamine | — | 0.5 | — |
| Propylene Glycol Mono-butylether | 4.0 | — | 3.0 |
| Ethylene Glycol Monobutylether | — | 3.0 | — |
| Isopropanol | 2.0 | 3.0 | 3.0 |
| Deionized Water and Minors (e.g., Perfume) | q.s. | q.s. | q.s. |

*All pH's adjusted to about 10.9

The following example shows the Filming/Streaking performance for various formulations including the preferred zwitterionic/alkanol amine combinations.

EXAMPLE III

| Ingredient | Formula No.* (Wt. %) 1 | 2 | 3 |
|---|---|---|---|
| Ralufon ® DL | 0.20 | 0.20 | 0.20 |
| Monoethanolamine | — | 0.5 | 0.5 |
| Isopropanol | — | — | 3.0 |
| Propylene Glycol Mono-butylether | — | — | — |
| Sodium Hydroxide | — | — | — |
| Deionized Water | q.s. | q.s. | q.s. |

| Ingredient | Formula No.* (Wt. %) 4 | 5 | 6 | 7 |
|---|---|---|---|---|
| Ralufon ® DL | 0.20 | 0.20 | 0.20 | 0.20 |
| Monoethanolamine | 0.5 | — | — | — |
| Isopropanol | 3.0 | — | — | — |
| Propylene Glycol Mono-butylether | 3.0 | — | 3.0 | 3.0 |
| Sodium Hydroxide | — | * | — | * |
| Deionized Water | q.s. | q.s. | q.s. | q.s |

Ralufon ® DL (Raschig Corp.) is Lauryl-dimethyl-ammonium-3-sulfopropyl 3-(lauryl,dimethyl,ammonium)-propyl-sulfonate)
*pH adjusted to 10.8 with NaOH, this matches the pH of the products with monoethanolamine in them.

In Example III, the following test was used to evaluate the products' performance.

Filming/Streaking Stress Test

Procedure:

A paper towel is folded into eighths. Two milliliters of test product are applied to the upper half of the folded paper towel. The wetted towel is applied in one motion with even pressure from top to bottom of a previously cleaned window or mirror. The window or mirror with the applied product(s) is allowed to dry for ten minutes before grading by expert judges.

Grading:

Expert judges are employed to evaluate the specific areas of product application for amount of filming/streaking. A numerical value describing the amount of filming/streaking is assigned to each product. For the test results reported here a 0–10 scale was used.

0=No Filming/Streaking

10=Poor Filming/Streaking

Room temperature and humidity have been shown to influence filming/streaking. Therefore these variables are always recorded.

Filming/Streaking Stress Test on Glass Windows (Four Replications at 73° F. and 53% Relative Humidity)

| Formula No. | Mean Rating |
|---|---|
| 1 | 3.8 |
| 2 | 0.3 |
| 3 | 0.4 |
| 4 | 1.0 |
| 5 | 5.4 |
| 6 | 7.3 |
| 7 | 8.2 |

The least significant difference between mean ratings is 0.8 at 95% confidence level.

What is claimed is:

1. An aqueous liquid hard surface detergent composition having excellent spotting/filming characteristics for cleaning window glass comprising: (a) from about 0.02% to about 1%, by weight of the composition, of zwitterionic detergent surfactant which has the formula:

$$R^3\text{-}[C(O)\text{-}N(R^4)\text{-}(CR^5{}_2)_n\text{-}]_mN(R^6)_2(+)\text{-}(CR^5{}_2)_p\text{-}Y(-)$$

wherein each Y is a carboxylate or sulfonate group, wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, with no more than about one hydroxy group in any ($CR^5{}_2$) moiety; m is 0 or 1; and each n and p is a number from 1 to about 4; (b) from about 0.05% to about 10%, by weight of the composition, of alkanolamine selected from the group consisting of monoethanolamine, beta-aminoalkanol containing from three to about six carbon atoms, and mixtures thereof; (c) from about 1% to about 30%, by weight of the composition, of a solvent, other than (b), having a hydrogen bonding parameter of less than about 7.7; and (d) the balance being an aqueous solvent system comprising water and, optionally, non-aqueous polar solvent with only minimal cleaning action selected from the group consisting of methanol, ethanol, isopropanol, ethylene glycol, propylene glycol, and mixtures thereof and minor ingredients.

2. The composition of claim 1 wherein (b) is monoethanolamine.

3. The composition of claim 2 wherein Y is a sulfonate group.

4. The composition of claim 1 wherein the level of said zwitterionic detergent surfactant is from about 0.02% to about 0.5% by weight of the composition.

5. The composition of claim 1 wherein said zwitterionic detergent surfactant is present at from about 0.02% to about 0.05% by weight of the composition and has the formula:

$R^3N(R^6)_2(+)\text{-}(CR^5{}_2)_p\text{-}Y(-)$ wherein each $R^3$ is an alkyl, or alkylene, group containing from about 10 to about 18 carbon atoms, each ($R^5$-) is selected from the group consisting of hydrogen and hydroxy groups with no more than about one hydroxy group in any ($CR^5{}_2$) moiety; m is 0 or 1; each ($R^6$) is selected from the group consisting of hydrogen, methyl, ethyl, propyl, hydroxy substituted ethyl or propyl and mixtures thereof; each Y is selected from the group consisting of carboxylate and sulfonate groups; and each p is a number from 1 to about 4.

6. The composition of claim 5 wherein Y is a sulfonate group, said $R^3$ group contains from about 10 to about 15 carbon atoms, each $R^6$ is methyl, one of the $R^5$ groups between the (+) and the (–) charge centers is a hydroxy group and the remaining $R^5$ groups are hydrogen, and p is 3.

7. The composition of claim 5 containing at least one cosurfactant selected from the group consisting of anionic detergent surfactants, nonionic detergent surfactants, and mixtures thereof.

8. The composition of claim 1 comprising said alkanolamine (b) to give a pit of from about 9.5 to about 13.

9. The composition of claim 8 wherein said pH is from about 9.7 to about 12.

10. The composition of claim 8 additionally comprising an alkali metal hydroxide to give a pH of from about 9.7 to about 11.3.

11. The composition of claim 1 wherein said solvent (C) is selected from the group consisting of dipropyleneglycomonobutyl ether, monopropyleneglycomonobutyl ether, and mixtures thereof.

12. The composition of claim 11 wherein said solvent (C) is monopropyleneglycomonobutyl other.

13. The composition of claim 11 containing at least one cosurfactant, the cosurfactant being present in a small amount as compared to said zwitterionic detergent surfactant.

14. The composition of claim 13 wherein said cosurfactant is an anionic detergent surfactant selected from the group consisting of $C_{12}$–$C_{18}$ alkyl sulfates, $C_{12}$–$C_{18}$ paraffin sulfonates, $C_{12}$–$C_{18}$ acylamidoalkylene aminoalkylene sulfonates at a pH of more than about 9.5, and mixtures thereof.

15. The composition of claim 1 containing at least one cosurfactant, the cosurfactant being present m a small amount as compared to said zwitterionic detergent surfactant.

16. The composition of claim 15 wherein said cosurfactant is an anionic detergent surfactant selected from the group consisting of $C_{12}$–$C_{18}$ alkyl sulfates, $C_{12}$–$C_{18}$ paraffin sulfonates, $C_{12}$–$C_{18}$ acylamidoalkylene aminoalkylene sulfonate at a pH of more than about 9.5, and mixtures thereof.

17. The composition of claim 1 packaged in a package that has means for creating a spray, the concentration of (a) being from about 0.02% to about 0.05% by weight of the composition.

18. The composition of claim 17 wherein said zwitterionic detergent surfactant which has the formula:

$R^3N(R^6)_2(+)\text{-}(CR^5{}_2)_p\text{-}Y(-)$ wherein each $R^3$ is an alkyl, or alkylene, group containing from about 10 to about 18 carbon atoms, each ($R^6$) is selected from the group consisting of hydrogen, methyl, ethyl, propyl, hydroxy substituted ethyl or propyl and mixtures thereof; each Y is selected from the group consisting of carboxylate and sulfonate groups; and each p is a number from 1 to about 4.

19. The composition of claim 18 wherein Y is carboxylate; and p is 1.

* * * * *